US005664880A

United States Patent [19]

Johnson et al.

[11] Patent Number: 5,664,880

[45] Date of Patent: Sep. 9, 1997

[54] HANDHELD GOLF COURSE DISTANCE COMPUTER FOR AUTOMATICALLY COMPUTING DISTANCES TO SEQUENTIALLY SELECTED POINTS

[75] Inventors: Robert D. Johnson, Littleton; Leopold G. Tomajko, Evergreen, both of Colo.

[73] Assignee: AGTsports, Inc., Tampa, Fla.

[21] Appl. No.: 274,905

[22] Filed: Jul. 14, 1994

[51] Int. Cl.[6] ..... G06G 7/48

[52] U.S. Cl. ..... 364/410; 473/131; 473/198; 473/407

[58] Field of Search ..... 364/410, 411; 273/32 R, 32 H; 473/131, 406, 198, 407

[56] References Cited

U.S. PATENT DOCUMENTS

| | | | |
|---|---|---|---|
| 3,805,411 | 4/1974 | Andrews, Jr. | 35/7 R |
| 4,367,526 | 1/1983 | McGeary et al. | 364/411 |
| 4,910,677 | 3/1990 | Remedio et al. | 364/410 |
| 5,095,430 | 3/1992 | Bonito et al. | 364/410 |
| 5,127,044 | 6/1992 | Bonito et al. | 364/411 |
| 5,146,557 | 9/1992 | Yamrom et al. | 364/410 |
| 5,245,537 | 9/1993 | Barber | 364/410 |
| 5,305,201 | 4/1994 | Mathews | 364/410 |
| 5,324,028 | 6/1994 | Luna . | |
| 5,438,518 | 8/1995 | Bianco et al. | 364/411 |
| 5,507,485 | 4/1996 | Fisher . | |

OTHER PUBLICATIONS

Golf Magazine, May, 1994, pp. 120–121.

*Primary Examiner*—Robert A. Weinhardt
*Attorney, Agent, or Firm*—William E. Hein

[57] ABSTRACT

A handheld golf course distance computer includes a graphics display and keyboard and is preprogrammed, using an external personal computer and optical data link, with alphanumeric and graphical information regarding each hole of a particular golf course. The alphanumeric information includes an identification of the course and a selected hole, information relating to hazards and/or the best method of play of the selected hole, the distance of play from various tees, the number of strokes required to par the hole, and typical playing time for the course. The actual or elapsed playing time from the beginning of play is also displayed. The graphical information, including details of the course terrain, is obtained from an aerial photograph of the course and converted to pixel information using commercially available personal computer software. The alphanumeric and graphical information associated with the selected hole may be selectively displayed. The distance between the player's location on the hole, as represented by the position of a cursor in the display, and the center of the green is computed and displayed. The distance between two locations on the hole, as represented by original and subsequent cursor positions, may also be computed and displayed.

9 Claims, 6 Drawing Sheets

HANDHELD GOLF COURSE DISTANCE COMPUTER FOR AUTOMATICALLY COMPUTING DISTANCES TO SEQUENTIALLY SELECTED POINTS

BACKGROUND AND SUMMARY OF THE INVENTION

This invention relates generally to the sport of golf and, more particularly, to a handheld computer that provides distance aiding information to a golfer. Inherently, the sport of golf is an individually challenging one in which players continuously strive to improve their scores through practice and the use of improved equipment and other aids. Next to proper stroke form, the most important aspects of a successful shot are direction add distance. Most golfers develop a relatively good feel for direction of their shots, but it is much more difficult to accurately determine distance to a given target.

The standard golf course consists of eighteen holes. The objective for each hole is to advance the ball from the tee-box to a distant hole using the least possible number of strokes. On a given course, each hole is assigned a numerical par value that represents the number of strokes ordinarily required of a high level player. Most golf courses provide markers at fixed distances of typically 150 yards from the center of the green, but most locations on the course are not marked or the marks, which are typically sprinkler covers, are not readily visible. In any event, any distance markings that are provided relate only to the distance from the mark to the center of the hole.

At some golf courses, scorecards are provided which include wall, roughly drawn diagrams of each hole on the course. Exemplary of such scorecards is the one described in U.S. Pat. No. 3,805,411 to Andrews, Jr. The diagrams provided on these scorecards are usually not sufficiently large nor do they provide sufficient detail to enable the golfer to make an accurate determination of distances relating to a particular hole. A determination of the distance between points other than the location of the player and the center of the green is not easily accomplished using scorecard maps. It is frequently desired to determine the distance from the location of the ball to obstacles or hazards associated with a particular hole to determine the optimum shot strategy for that particular hole. This information cannot be determined with any degree of accuracy from scorecard maps.

Prior art yardage booklets provide playing suggestions and a view of each hole and certain landmarks along with distances from a few points to some point on the green or tee. Each chosen point is located on a distance arc from the center of the green. If the golfer's present position is not on one of the distance arcs, he attempts to calculate the distance from his present position to the center of the green or tee by approximation relative to his position between two adjacent distance arcs. Since all distance information in these prior art yardage booklets is relative to a tee or green, a mental calculation involving as many as four distance arcs must be made if the golfer is attempting to advance the ball from a point other than the tee to a point other than the green. These location estimates and mental calculations typically result in errors. Moreover, the yardage booklets are provided in printed and bound form, so that changes made to a hole require republication of the entire yardage booklet.

A number of calculators for use by golfers are known in the prior art, exemplary of which is the electronic calculator described in U.S. Pat. No. 4,367,526 to McGeary et al., in which various data on players, courses, and contest arrangements is stored and manipulated and in which the numeric results of computations indicative of scores and results of specified contests between individual players are visually displayed.

Golf Magazine, May, 1994, describes a number of radio-frequency and laser based handheld and cart-mounted distance measuring devices that provide an indication of the distance from the player or a cart to the flagstick. However, these devices are not presently legal since they fall into the prohibited category of artificial devices that measure distance. In addition, the radio-frequency devices employ a number of transmitter towers installed at various locations around the course that facilitate distance computation by triangulation.

It is therefore the principal object of the present invention to provide a self-contained, handheld golf course distance computer in which an alphanumeric and graphic display of information, including an accurately scaled map, with respect to each hole of a particular golf course, is provided and in which the user may obtain a display of the distance from his location to any other point on the hole.

This and other objects are accomplished in accordance with the illustrated preferred embodiment of the present invention by providing a pre-programmed microprocessor having an associated keyboard and a re-programmable memory. Data regarding each hole of a particular golf course is conventionally loaded externally using a personal computer operating over an optical data link. A pre-programmed clock provides information relating to typical playing times for each hole so that players may pace themselves to more efficiently complete a round of golf.

DESCRIPTION OF THE PREFERRED EMBODIMENT

Referring now to FIG. 1–4, there is shown a plan view of the front panel 12 of the handheld golf course distance Computer 10 of the present invention. Front panel 12 includes a display 14 and a keyboard 16. Generally, the handheld golf course distance computer 10 displays a specific hole or enlarged portion of that hole to be displayed in response to commands entered by the player. Display 14 preferably comprises a 320×240 pixel display for displaying certain alphanumeric information regarding a particular hole, exemplary of which is the information shown in display 14 of FIG. 1. In addition, the player can command the display of overall or enlarged graphical representations of that hole, exemplary of which are the graphical representations illustrated in FIGS. 2–4.

Figure 5:
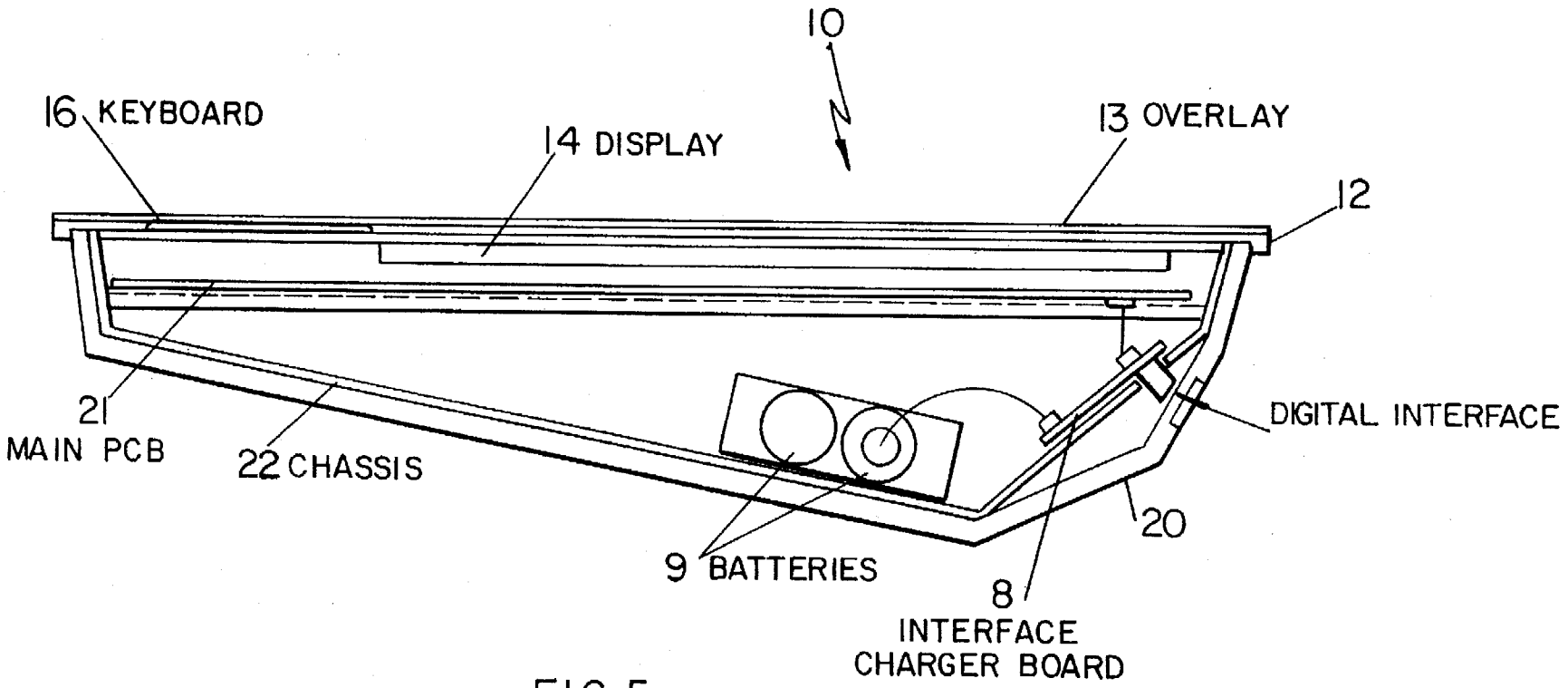
FIG. 5 is a sectional pictorial diagram of the handheld golf course distance computer of FIGS. 1–4 illustrating the locations of various components therein.

Referring now to the sectional pictorial diagram of FIG. 5, a housing 20 supports front panel 12, which in turn retains display 14 and keyboard 16. An overlay 13 provides indicia for keyboard 16 and a clear area through which display 14 may be viewed. In addition, overlay 13 provides a seal for protection of the electronic components mounted on a main printed circuit board 21 within housing 20. A chassis 22 within housing 20 supports the printed circuit board 21 and panel 12. A battery pack 9, mounted on chassis 22, provides operating power to the handheld golf course distance computer 10. An interface charger printed circuit board 8 provides connection to battery pack 9 for recharging purposes.

Figure 6:
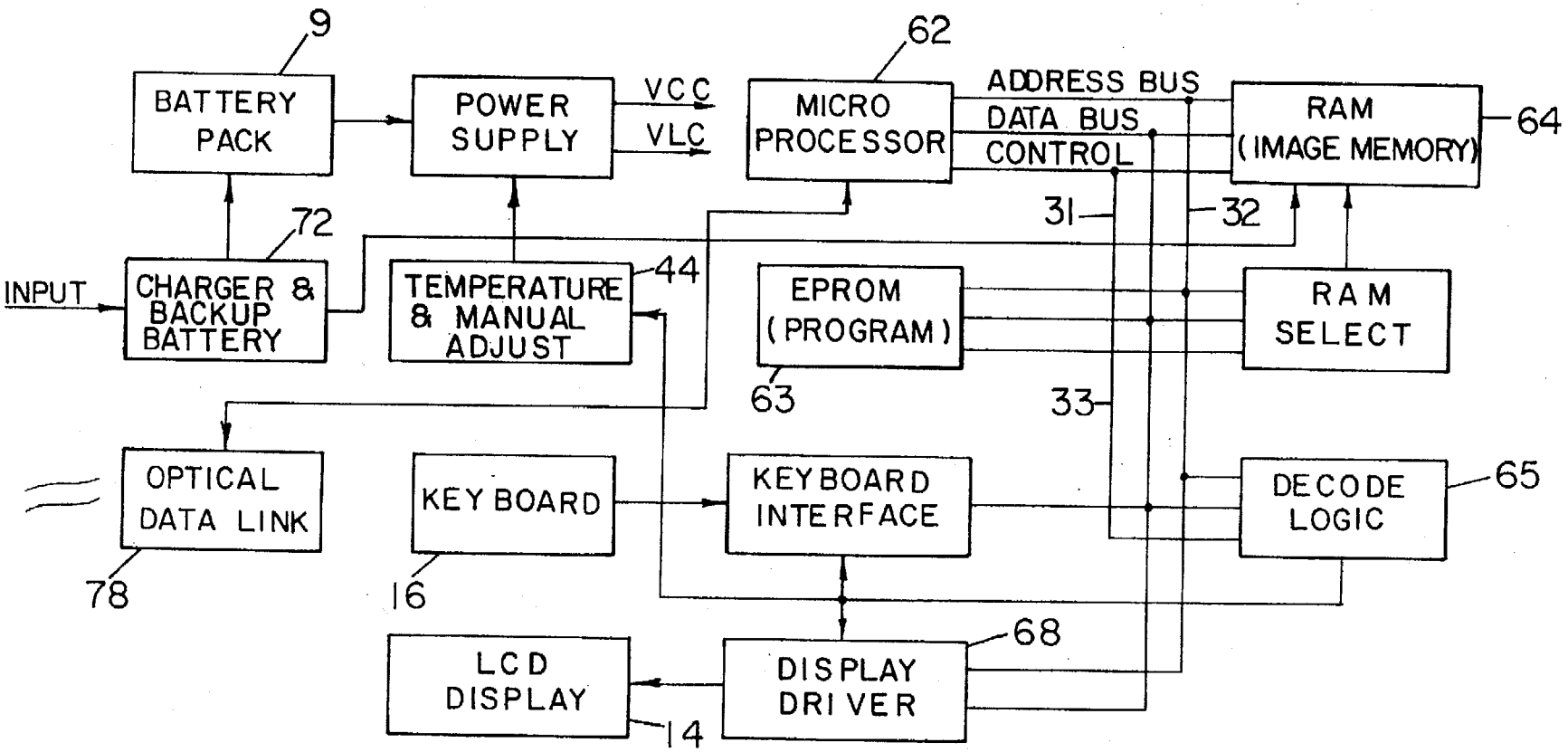
FIG. 6 is a block diagram of the hardware components employed in the handheld golf course distance computer of FIGS. 1–5 and the data flow therebetween.

Referring now to FIG. 6, there is shown a block diagram of the commercially available electronic components mounted on printed circuit board 21 of FIG. 5. These include a microprocessor 62, read-only memory (ROM) 63, eight read-write memory (RAM) devices 64, and a decoding logic circuit 65. A display driver 68, which may comprise, for example, an Epson E-1330 display driver, provides the signals necessary to drive display 14. The drive voltage to display 14 may be varied manually via keyboard 16 to provide optimum display clarity. It is also automatically varied via a temperature sensing circuit 44. A back-up battery 72 is employed to supply power to read-write memory 64 to preserve the data stored therein in the event of failure of the battery pack 9. An optical data link 78, controlled by microprocessor 62 and ROM 63, comprises a pair of opto-electronic devices for permitting the transfer of data between the handheld golf-course distance computer 10 and an external personal computer, for example. The information from which the graphical representation of each hole of a golf course is generated for display on the handheld distance computer of the present invention is acquired from an aerial photograph of a particular golf course at a scale of approximately 1"=100'. All features desired to be graphically displayed, such as tee boxes, fairways, landscape features, hazards, and greens, for example, are traced from the aerial photograph and scanned into and saved in a PC Paintbrush .PCX file on an external personal computer. The .PCX file image is then traced into a CorelDRAW .CDR file and scaled to the proper size such that a full image of a particular hole occupies the entire area of display 14.

Microprocessor 62 may comprise a Hitachi 64180 microprocessor. An operating program is stored within ROM 63, which communicates with microprocessor 62 via an eight-bit data bus 31, a twenty-bit address bus 32, and a control bus 33. Control bus 33 determines which of the ROM and RAM memories 63, 64 is being accessed and the direction of memory data transfer. ROM 63 and RAM 64 may comprise any of a number of commercially available memory devices, such as those manufactured and marketed by Hitachi. These memories are functionally identical as being able to interface to the data bus 31, address bus 32, and control bus 33.

When using the handheld golf course distance computer 10 of the present invention, the player typically selects a specific hole of the preprogrammed golf course. However, when the computer is initially turned on, the computer will automatically select the first hole to be played, as preprogrammed into the computer. Other holes may be selected by appropriately actuating one of the HOLE keys 102, 104 on the front panel keyboard 16. Selection of a specific hole causes programmed alphanumerical information associated with that hole to be visually displayed on front panel display 14. Well known software for producing alphanumeric information on a visual display may be used for this purpose. Typical of the displayed alphanumeric information is that illustrated in Figure I and includes identification of the golf course and the selected hole, information relating to hazards and/or the best method of play, the distance of play from various tees, the number of strokes required to par the hole, and typical playing time for the course. The actual or elapsed playing time from a point in time at which the computer is initialized is also displayed. Initialization is typically performed when play is begun on the first hole of the course.

While displaying the alphanumeric screen described above, the contrast of display 14 may be adjusted by actuating either of the CURSOR keys 106, 108. Displayed information may thereby be made lighter or darker to satisfy the player, compensating for his or her vision and the angle at which the distance computer is held. If no key of keyboard 16 is actuated for a period of 1–2 minutes, display 14 will become inactive to conserve power. While in this standby condition, actuation of any key will cause display 14 to become active, resulting in a display of the same information previously displayed. Software for causing the deactivation and reactivation of displays to conserve power is well known to those skilled in the art.

Figure 1:
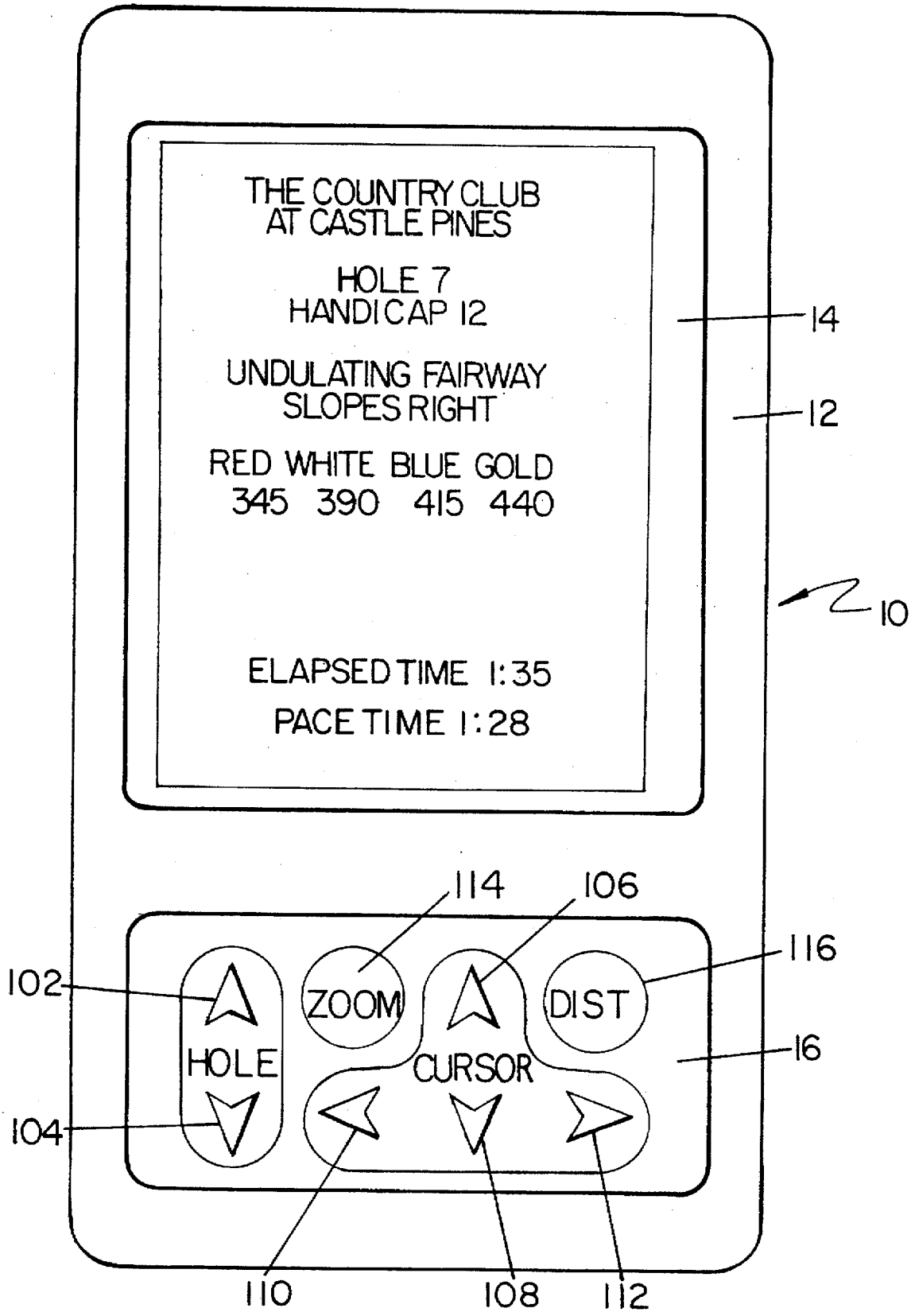
FIG. 1 is a plan view of the front panel of the handheld golf course distance computer of the present invention illustrating a keyboard and a display that shows alphanumeric information typically displayed for a particular golf course hole.
Figure 2:
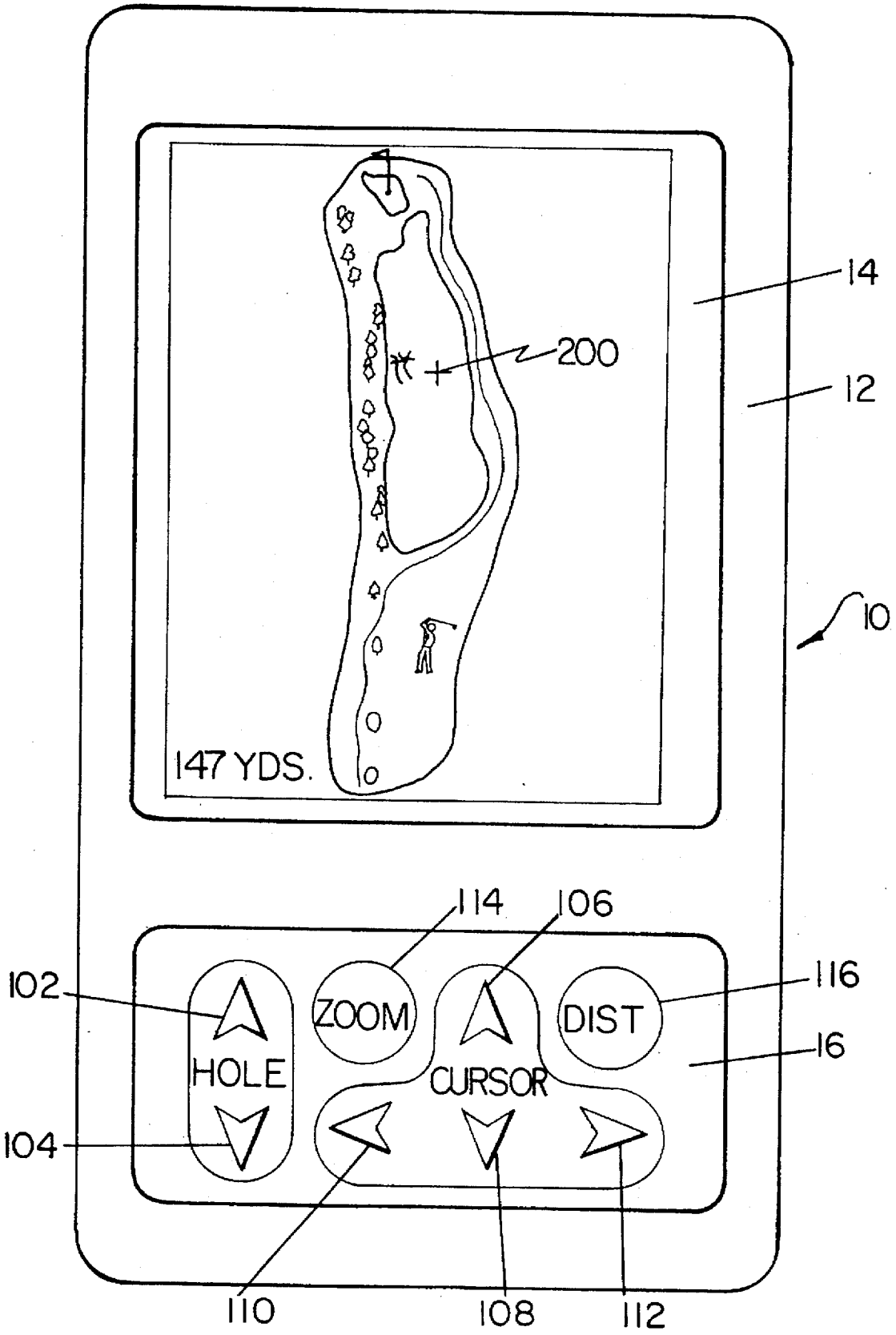
FIG. 2 is a plan view of the front panel of the handheld golf course distance computer of the present invention illustrating a graphical display of a typical golf course hole.
Figure 3:
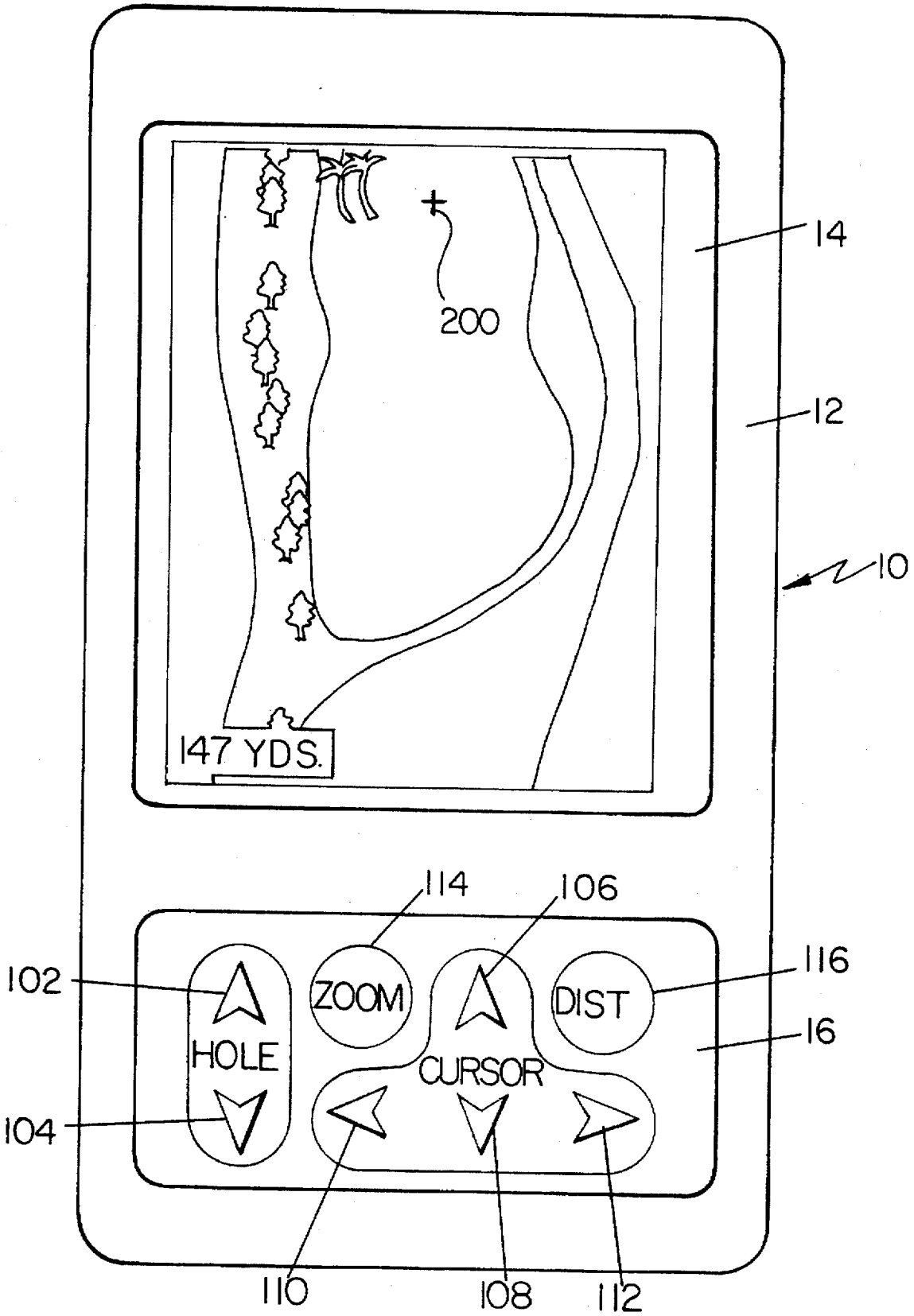
FIG. 3 is a plan view of the front panel of the handheld golf course distance computer of the present invention illustrating a first level zoomed graphical display of the typical golf course hole shown in FIG. 2.
Figure 4:
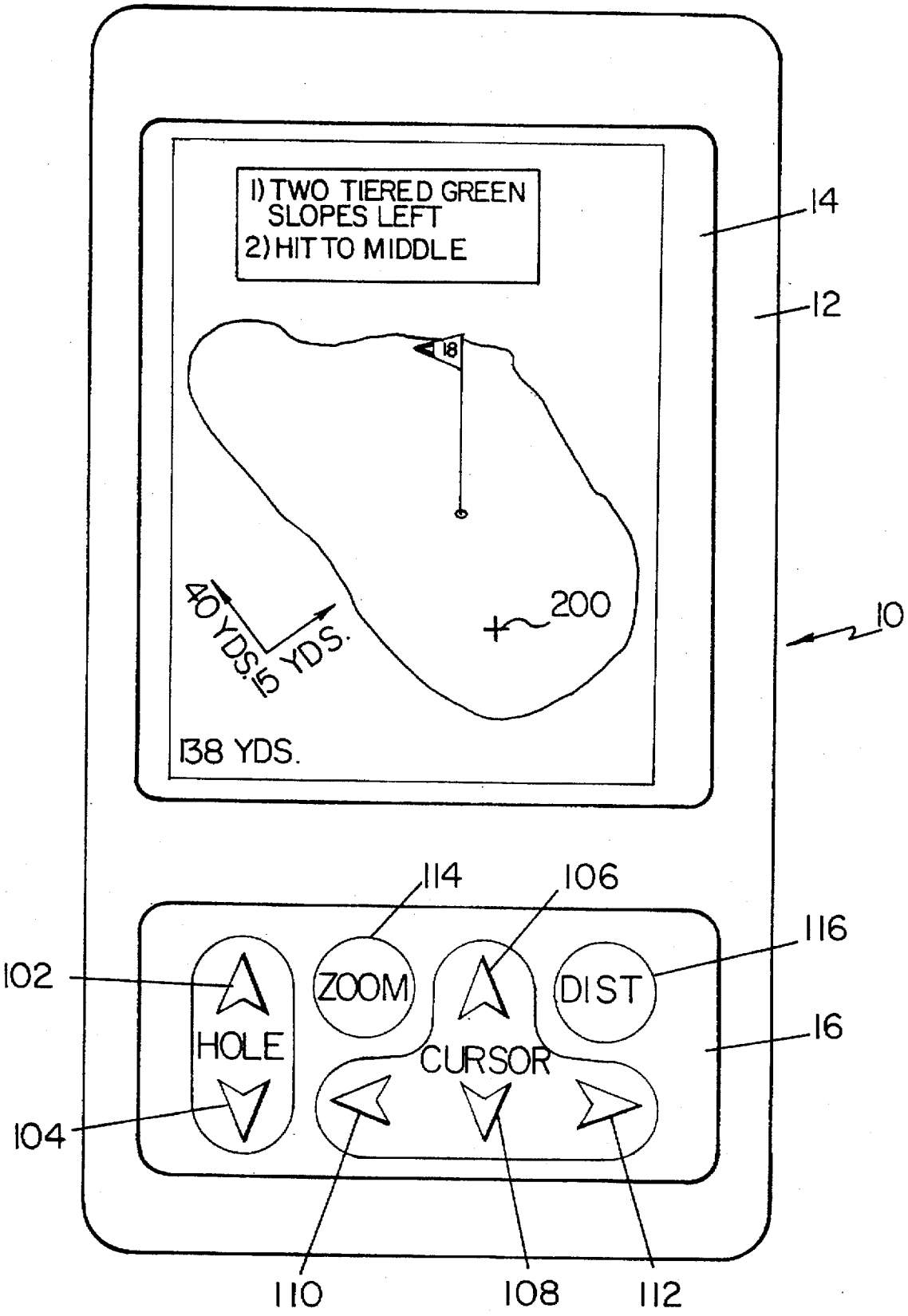
FIG. 4 is a plan view of the front panel of the handheld golf course distance computer of the present invention illustrating a second level zoomed graphical display of the typical golf course hole shown in FIGS. 2 and 3.

Actuation of either of the cursor keys 110, 112 will result in displaying a full view of the selected hole, as illustrated in FIG. 2. A cursor 200 is initially positioned in display 14 at one of the tees. Commonly known software for moving a cursor in a computer display allows cursor 200 to be moved to various positions on display 14 by selectively actuating the cursor keys 106,108, 110, 112. Programmed boundaries limit positioning of cursor 200 to typical playable locations on the displayed hole. A ZOOM key 114 may be actuated to provide enlarged images of the selected hole, as illustrated in FIGS. 3 and 4. These enlarged images allow the player to more accurately position cursor 200 to correspond to the player's present position on the hole and to more clearly view the displayed natural and artificial features of the hole. The enlarged images selected by actuation of ZOOM key 114 are generally centered in display 14 about the location of cursor 200 at the time the ZOOM key 114 is actuated.

Actuation of a DIST key 116 of keyboard 16 causes a yardage number displayed in the lower lefthand corner of display 14 to be updated to reflect the distance in yards between the player's location on the hole as represented by the position of cursor 200 in display 14 and the center of the green. Simultaneously with actuation of DIST key 116, display 14 changes to the full view of the golf hole, as illustrated in FIG. 2, with cursor 200 being shown in its position at the time DIST key 116 is actuated. Subsequent positioning of cursor 200 results in updating the displayed yardage number to reflect the distance between the location on the hole represented by cursor 200 at the time DIST key 116 was actuated and the location on the hole represented by the current position of cursor 200. From any of the graphical displays illustrated in FIGS. 2–4, a new hole may be selected by actuating one of the HOLE keys 102, 104, which will result in a display of the alphanumeric information associated with that newly selected hole.

The display 14 comprises a 240×320 matrix of evenly spaced pixels, each having associated x and y coordinates, which are assigned a scale. Software stored in ROM 63 executes the equation $x^2+y^2=z^2$ to calculate the distance from the pixel at which cursor 200 is presently positioned to any other pixel on display 14 in response to actuation of DIST key 116. The distance so computed may be to a predesignated point such as the center of the green or to a point designated by positioning the cursor at any point of the player's choice. When cursor movement is stopped, the distance to that point is then calculated.

We claim:

1. A self-contained handheld golf course distance computer for use by a player while playing a round of golf on a particular golf course, the computer comprising:

keyboard input means for enabling the player to enter one or more commands into the computer;

memory means for storing routines and subroutines of instructions to be performed by the computer in executing commands entered by the player and for storing alphanumeric and graphical information regarding each hole of said golf course;

computing means, coupled to said keyboard input means and memory means, for selectively executing the routines and subroutines of instructions to be performed in executing commands entered by the player; and liquid crystal display means for displaying the stored alphanumeric and graphical information regarding a selected hole of said golf course, said display means including a displayed cursor for enabling the player to designate a particular position on a graphical display of a selected hole;

said computing means being responsive to entry of a hole command entered by the player for causing said display means to selectively display said alphanumeric and graphical information regarding the selected hole, said computing means being responsive to entry of one or more cursor commands from said keyboard input means, during display of said graphical information regarding the selected hole for positioning said displayed cursor at an initial cursor position corresponding to the player's present position on the selected hole, said computing means thereafter being responsive to entry of a distance command from said keyboard input means for computing a distance from said initial cursor position to a predetermined point on said selected hole and for causing said computed distance to be displayed on said display means, and said computing means thereafter being responsive to sequential repositioning of said displayed cursor at any number of new cursor positions for automatically computing and displaying, each time said cursor is repositioned it a new cursor position a distance from said initial cursor position to the new cursor position.

2. A handheld golf course distance computer as in claim 1, wherein said predetermined point on said selected hole is a center point of a green area of said selected hole.

3. A handheld golf course distance computer as in claim 1 wherein said alphanumeric information regarding each hole of said golf course comprises alphanumeric information identifying said golf course and a selected hole thereon, information relating to hazards, a distance of play from various tees of the selected hole, a number of strokes required to par the selected hole, and a typical playing time for said golf course.

4. A handheld golf, course distance computer as in claim 1 wherein said graphical information regarding each hole of said golf course comprises a scaled graphical map of each hole.

5. A handheld golf course distance computer as in claim 4 wherein said computing means is responsive to entry of a zoom command entered by the player, while graphical information regarding a selected hole is being displayed, for causing said display means to display an enlarged graphical map of the selected hole.

6. A handheld golf course distance computer as in claim 5 wherein said computing means is responsive to successive zoom commands entered by the player, while graphical information regarding a selected hold is being displayed, for causing said display means to display successively enlarged graphical maps of the selected hole.

7. A handheld golf course distance computer as in claim 1 wherein said computing means is responsive to initialization of said computer for causing said display means to display alphanumeric information regarding a preprogrammed first hole to be played.

8. A handheld golf course distance computer as in claim 1 wherein said alphanumeric information regarding each hole of said golf course includes a typical playing time for said golf course and an elapsed time that is computed as a running time period that has elapsed since initialization of said computer.

9. A process for enabling a player to compute the distance between any two locations on a hole of a golf course, the process comprising the steps of:

storing a graphical scaled map of the hole in a computer memory;

displaying said graphical scaled map to the player;

positioning a displayed cursor to an initial cursor position on the displayed graphical scaled map that corresponds to a current location of the player on the hole;

computing, in response to a distance command, a distance between the initial cursor position and a predetermined location on the hole;

automatically displaying the computed distance;

subsequently sequentially positioning said displayed cursor at any number of new cursor positions on the displayed graphical scaled map;

computing a distance, each time the cursor is positioned at a new cursor position, between said initial cursor position and the new cursor position; and automatically displaying the computed distance between said initial cursor position and the new cursor position.

* * * * *